US008196552B2

(12) United States Patent
Whitford et al.

(10) Patent No.: US 8,196,552 B2
(45) Date of Patent: Jun. 12, 2012

(54) SYSTEM AND METHOD TO REDUCE STANDBY ENERGY LOSS IN A GAS BURNING APPLIANCE

(75) Inventors: Geoffrey Mervyn Whitford, Sydney (AU); Brendon John Ruwoldt, Sydney (AU)

(73) Assignee: Invensys Controls Australia Pty. Ltd., Pendle Hill, NSW (AU)

( * ) Notice: Subject to any disclaimer, the term of this patent is extended or adjusted under 35 U.S.C. 154(b) by 923 days.

(21) Appl. No.: 12/175,551

(22) Filed: Jul. 18, 2008

(65) Prior Publication Data

US 2010/0012048 A1 Jan. 21, 2010

(51) Int. Cl.
*F23L 13/00* (2006.01)

(52) U.S. Cl. ..... 122/14.21; 122/135.1; 126/285 R

(58) Field of Classification Search ..... 122/135.1, 122/14.2, 14.21; 126/285 R; 110/163; 431/42–44, 431/60, 61, 75

See application file for complete search history.

(56) References Cited

U.S. PATENT DOCUMENTS

| | | | | |
|---|---|---|---|---|
| 1,813,395 | A | 7/1931 | Fraser | |
| 1,842,337 | A | 1/1932 | Te Pas | |
| 1,968,319 | A | 7/1934 | Shively | |
| 1,991,557 | A * | 2/1935 | Johnson | 122/14.1 |
| 2,112,554 | A * | 3/1938 | Beam | 431/20 |
| 2,953,198 | A | 9/1960 | Hajny | |
| 3,166,248 | A | 1/1965 | Fleer | |
| 3,405,999 | A | 10/1968 | Riehl | |
| 4,076,171 | A * | 2/1978 | Swenson | 236/1 G |
| 4,131,413 | A | 12/1978 | Ryno | |
| 4,164,936 | A | 8/1979 | Dottore, Jr. | |
| 4,182,483 | A * | 1/1980 | Swenson | 236/1 G |
| 4,192,310 | A | 3/1980 | Brodin | |
| 4,204,833 | A | 5/1980 | Kmetz et al. | |
| 4,225,080 | A | 9/1980 | Barth | |
| 4,264,296 | A | 4/1981 | Folkerts | |
| 4,266,929 | A * | 5/1981 | Swenson | 431/20 |

(Continued)

FOREIGN PATENT DOCUMENTS

CA 2409271 A1 4/2003

(Continued)

OTHER PUBLICATIONS

U.S. Appl. No. 12/175,504, filed Jul. 18, 2008, Whitford et al.

(Continued)

*Primary Examiner* — Gregory A Wilson

(74) *Attorney, Agent, or Firm* — Reinhart Boerner Van Deuren P.C.

(57) ABSTRACT

A system to reduce standby losses in a hot water heater is presented. The system utilizes a safety relay valve between the combination gas controller and the burner. The safety relay valve bypasses gas to a damper actuator valve to position a flapper valve located over the flue pipe. Once the flapper valve has opened to ensure combustion, the gas is allowed to flow back to the safety relay valve. Some of the bypass gas may be diverted to boost the pilot or to supply a booster. The safety relay valve is then opened to allow the gas supply to the burner. Once the burner is turned off by the combination gas controller, the small amount of bypass gas bleeds out of the damper actuator valve to close the flapper valve to reduce standby losses through the flue pipe, and to allow the safety relay valve to close tightly.

21 Claims, 12 Drawing Sheets

U.S. PATENT DOCUMENTS

| | | | | |
|---|---|---|---|---|
| 4,289,271 | A | 9/1981 | Barth | |
| RE30,936 | E | 5/1982 | Kmetz et al. | |
| 4,386,731 | A | 6/1983 | Barth | |
| 4,408,567 | A | 10/1983 | Morton | |
| 4,413,975 | A | 11/1983 | Turner et al. | |
| 4,545,009 | A * | 10/1985 | Muraki et al. | 700/44 |
| 4,770,160 | A | 9/1988 | Schimmeyer | |
| 4,778,378 | A | 10/1988 | Dolnick et al. | |
| 5,039,006 | A | 8/1991 | Habegger | |
| 5,239,947 | A | 8/1993 | Schimmeyer | |
| 5,393,221 | A | 2/1995 | McNally | |
| 5,447,125 | A | 9/1995 | McNally et al. | |
| 5,511,971 | A * | 4/1996 | Benz et al. | 431/9 |
| 5,682,841 | A | 11/1997 | Schimmeyer et al. | |
| 5,732,692 | A | 3/1998 | Schimmeyer | |
| 5,911,217 | A | 6/1999 | Dameworth | |
| 6,418,883 | B2 | 7/2002 | Bourke et al. | |
| 6,546,897 | B1 | 4/2003 | Edds et al. | |
| 6,584,940 | B1 | 7/2003 | Khadkikar et al. | |
| 7,311,064 | B2 | 12/2007 | Schimmeyer | |
| 7,818,095 | B2 * | 10/2010 | Hotton et al. | 700/300 |
| 2005/0066958 | A1 * | 3/2005 | Guzorek | 126/285 R |

FOREIGN PATENT DOCUMENTS

| | | | |
|---|---|---|---|
| CA | 2426723 | A1 | 7/2003 |
| CA | 2482509 | A1 | 3/2005 |
| EP | 0019671 | A1 | 5/1979 |
| GB | 528827 | | 11/1940 |
| GB | 942650 | | 11/1963 |
| GB | 953982 | | 4/1964 |
| GB | 1 475 133 | | 6/1977 |
| JP | 56119420 | | 9/1981 |
| JP | 57188950 | | 11/1982 |
| JP | 58033050 | | 2/1983 |
| JP | 59157422 | | 9/1984 |
| JP | 60-226623 | | 11/1985 |
| JP | 62063140 | | 3/1987 |
| JP | 63021404 | | 1/1988 |
| JP | 4045320 | | 2/1992 |
| JP | 2007232262 | | 9/2007 |
| WO | WO 95/17631 | A1 | 6/1995 |
| WO | WO 00/40906 | A2 | 7/2000 |
| WO | WO 2006/135319 | A1 | 12/2006 |

OTHER PUBLICATIONS

S. K. Sarkar, Flame traps—a technical note, journal, Jul. 1987, 5 pages, pp. 323-327, Journal of Mines, Metals & Fuels.

J. A. Harris et al., Flame stability-principles and practice, journal, Mar. 10, 1978, 22 pages, London and Southern Junior Gas Association.

Ken Lapp et al., Detonation Flame Arrester Qualifying Application Parameter for Explosion Prevention in Vapor Handling Systems, paper, Apr. 1995, 8 pages, pp. 139-146, Process Safety Progress (vol. 14, No. 2), Westech Industrial Ltd., 5636 Burbank Crescent , S.E., Calgary, Alberta, Canada T2H 1Z6.

R. P. Wilson et al., Flame Arrestor Design Requirements for Prolonged Exposure to Methane/Air, and Gasoline/Air Flames, report, Sep. 1978, 53 pages, Report No. CG-D-73-78, U.S. Department of Transportation, United States Coast Guard, Office of Research and Development, Washington, D.C. 20590.

U.S. Appl. No. 12/687,159, filed Jan. 14, 2010, Whitford et al.

* cited by examiner

SYSTEM AND METHOD TO REDUCE STANDBY ENERGY LOSS IN A GAS BURNING APPLIANCE

FIELD OF THE INVENTION

This invention generally relates to energy conservation systems, and more particularly to energy conservation systems to be employed with gas burning appliances to reduce standby losses associated therewith.

BACKGROUND OF THE INVENTION

It has now been recognized that the world's environment is suffering too much from global warming caused by greenhouse gas exposure in the atmosphere. To address this problem governments are now starting to adopt targets for reducing the emission of greenhouse gases to the environment and play their part to address this problem for future generations. While some countries have not adopted a firm goal, other countries, for example Australia, have adopted a policy for the reducing greenhouse gases by 20% by the year 2020.

Greenhouse gases can be emitted from cars, industry, farming, and households to name a few. While certainly not as apparent as a large factory with tall smokestacks, within a normal household the gas burning appliances, such as furnaces, water heaters, etc., all release such greenhouse gases as a by-product of the combustion process itself. While the appliance industry has taken a leading role in energy efficiency and environmental concern, further improvement is always foremost in mind of the appliance design engineer.

With such further improvement in mind, especially with the increased awareness of global climate change and changing governmental regulations, it is noted that hot water heaters, both internal and externally installed units, can be one of the more fairly inefficient appliances in energy conservation, and therefore require the burning of additional fuel to maintain the set point temperature. This, of course, results in the additional production of greenhouse gas beyond that which a more efficient appliance would produce.

A typical hot water heater includes a vertical tank with a centrally located flue pipe. A gas burner is positioned underneath the tank and is controlled by a combination gas controller. The combination gas controller incorporates an On/Off valve, a pilot safety circuit, pilot and main burner pressure regulators and their associated supply pipe connections, as well as a thermostat to control the hot water heater to maintain the water in the storage tank at a predetermined temperature.

Upon the thermostat calling for more heat, the main gas valve opens to allow gaseous fuel (gas) to flow to the main burner where it is ignited by the pilot light. Ignition and combustion of the gas results in hot flue gas being generated. The heat from the hot flue gases is transferred to the cold water via the bottom of the tank and through the walls of the central flue pipe. The flue gases exit out the top of the hot water heater.

There are generally two types of hot water heaters used throughout the world classified by their installation location. For an indoor water heater such as used in the North American market, the hot flue gases exit through a draft diverter that is connected to a flue pipe which pipes the flue gases safety to an outside location. Air for combustion of the gas is drawn into the combustion chamber at the bottom of the hot water heater. For an outdoor hot water heater such as used in the Australian market, the flue gases pass safely through a balanced flue terminal at the top of the heater to the outside atmosphere. The balanced flue terminal is so designed to allow a continuous supply of air for combustion irrespective whether the burner is on or off under all types of wind conditions. The air for combustion is transferred to the bottom of the heater internally within the appliance.

One of the current disadvantages for hot water heaters is the overall service efficiency of the appliances. Service efficiency is defined as the energy delivered to the hot water from the hot water heater each day, divided by the energy burnt in the gas to heat the water and to maintain the hot water in the tank at the desired temperature. The service efficiency may vary from around 0.50 or 50% for poor performing appliances, to appliances just complying to US regulations around 0.59, to superior products from 0.64 or 64% service efficiency. Low service efficiency may be due to poor thermal efficiency of the heat into the water when the burner is on and/or excessive heat losses when the burner is off.

While a small percentage of the heat loss may be caused by poor insulation from the outside of the tank, the majority of the losses are more likely a result of excessive losses from the hot primary flue pipe (heat exchanger) in the middle of the heater. This pipe is in contact with the hot water in the tank, and is designed to provide excellent heat transfer with the water to improve the "heat in" efficiency.

However, just as heat is transferred into the water when the burner is on, heat is also transferred out of the water when the burner is off. As a result of this standby heat loss, relatively cold air is continually being heated up and flows out of the hot water heater due to a thermo-syphoning effect by the flue pipe when the burner is off. Since the main burner is only on for one to two hours per day heating the stored water to keep it ready for use, the surfaces inside the flue pipe are exposed to the relatively cooler air for the remaining 22 hours. This natural cooling of the heated water via the flue pipe forces the thermostat to occasionally turn on the burner to continually top up the stored hot water to the desired temperature.

Recognizing this standby heat loss problem, there have been many attempts at providing some form of a flue damper that closes to limit the escape of heat through the flue pipe when the burner is turned off and that reliably opens to let the flue gases escape when the burner is on. Indeed, laboratory tests have proven that dampers can reduce the standby losses of a hot water heater by up to approx. 50%. This relates to approx. 500 Btu/h (0.50 Mj/h), which is a huge amount of energy considering the product life to 10 to 15 years. While such a damper could be electrically powered, such a damper would require additional power use and would need to be driven by a reliable supply. Gas powered dampers, that is dampers driven by the gas used for combustion, alleviate the problems of additional electrical power use and reliable supply. Unfortunately, the appliance industry generally and hot water heater manufacturers specifically have been frustrated by the fact that gas operated dampers "nearly work". They are not popular and commonly have many problems and service issues.

One significant problem experienced by gas operated flue dampers relates to candling of the diminishing flame on shut down of conventional burners and low NOx burners. This candling effect results from the draining of the gas in the burner feed pipe that leads from the damper actuator valve to the burner after the burner has been commanded off. Since the gas operated damper valve is located on the flue pipe at the top of the hot water heater and the burner is located at the bottom, the gas pipe from the valve to the burner runs at least the length of the storage tank. As a result of the existence of gas in the pipe after the valve have been shut, a small flame at the injector continues to burn until the pipe is drained, which results in the gradual build up of soot on the burner. This, in turn, often results in poor combustion, further increasing the production of greenhouse and other dangerous gasses. Candling is especially a problem with installations where the gaseous fuel used is heavier than air such as propane, butane gas, etc.

To address the systemic problem of candling with prior gas operated dampers, some designs incorporate an additional damper valve bleed line, a flow orifice member, and a separate vent pilot. Unfortunately, such additional plumbing and components increase the complexity and cost of such systems, as well as reducing the overall reliability of the system due to the increase in components. In the highly cost competitive appliance industry, even with the overall lifetime cost of operation reduction and with the reduction in production of greenhouse gasses, such additional expense makes such hot water heaters undesirable by consumers.

Another problem with some gas controlled damper valves is that they can trap gas within the valving damper system. This often results in allowing the damper only partially to close the damper, reducing the energy savings by allowing some flow therethrough.

There is a need, therefore, for a gas operated damper system for gas burning appliances, such as a hot water heater, to reduce standby losses therefrom that overcomes the above described and other problems existing in the art. Embodiments of the invention provide such an energy savings damper system. These and other advantages of the invention, as well as additional inventive features, will be apparent from the description of the invention provided herein.

BRIEF SUMMARY OF THE INVENTION

In view of the above, embodiments of the present invention provide a new and improved standby heat loss control system that overcomes one or more of the problems exiting in the art. More specifically, embodiments of the present invention provide a new and improved gas operated damper system for a hot water heater to enable hot water heaters to operate more efficiently thus reducing greenhouse gases. Preferably, embodiments of the present invention provide a new and improved gas operated damper that reduces the standby heat losses that occur as a result of thermo-syphoning of the heat from the hot water in the storage tank of a hot water heater by the flue pipe when the burner is off.

In particular, embodiments of the present invention provide a damper actuator valve and safety relay valve downstream of the combination gas controller. Both valves are operated in series by the use of bleed gas supplied by the combination gas controller. The bleed gas pressure operates the appliance damper actuator system in a controlled and defined safe manner, then supplies gas to operate the safety relay valve.

In one embodiment, the safety relay valve is configured to bypass a small amount of gaseous fuel to the damper actuator valve when the thermostat in the combination gas controller calls for heat. The bleed gas flows to the damper actuator valve and causes operation of the damper via a damper flapper valve to open the flue pipe. When the damper is open, and only then, the damper actuator valve, via a damper actuator safety valve, allows the bleed gas to be piped back down to the safety relay valve to actuate it, opening it and allowing gas to flow to the main burner of the hot water heater.

In one of the preferred embodiments, the system automatically opens and closes the damper actuator valve, its associated mechanism and the safety relay valve in a defined and controlled manner. The valving is designed so that no gas can physically pass to the main burner if the damper actuator valve and connected mechanisms have not moved open sufficiently for good combustion. In addition, the damper actuator valve and connected mechanism automatically and safely close off the appliance's flue pipe (heat exchanger) from free ventilation immediately after the burner off cycle is completed.

The configuration of valves prevents gas from passing to the main burner until the piped bleed gas pressurizes a damper actuator valve diaphragm, which in turn moves the diaphragm and the corresponding linkage attached to the top (air side) of the diaphragm to open the damper flapper valve at the outlet of the water heater flue pipe.

In one embodiment, the damper diaphragm has underside linkages to a damper actuator safety valve on the gas side. Continued diaphragm movement after opening the damper finally drags a damper actuator safety valve from its seat, thereby allowing bleed gas to pass. This bleed gas then pressurizes the safety relay valve. A diaphragm in the safety relay valve is forced to move by this pressurizing bleed gas, which opens the main relay valve to allow gas to flow to the main burner. The bleed gas, as it is continually being passed from the combination gas controller, through the damper actuator valve, and back to the safety relay valve, is finally mixed into the main gas to the burner.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1:
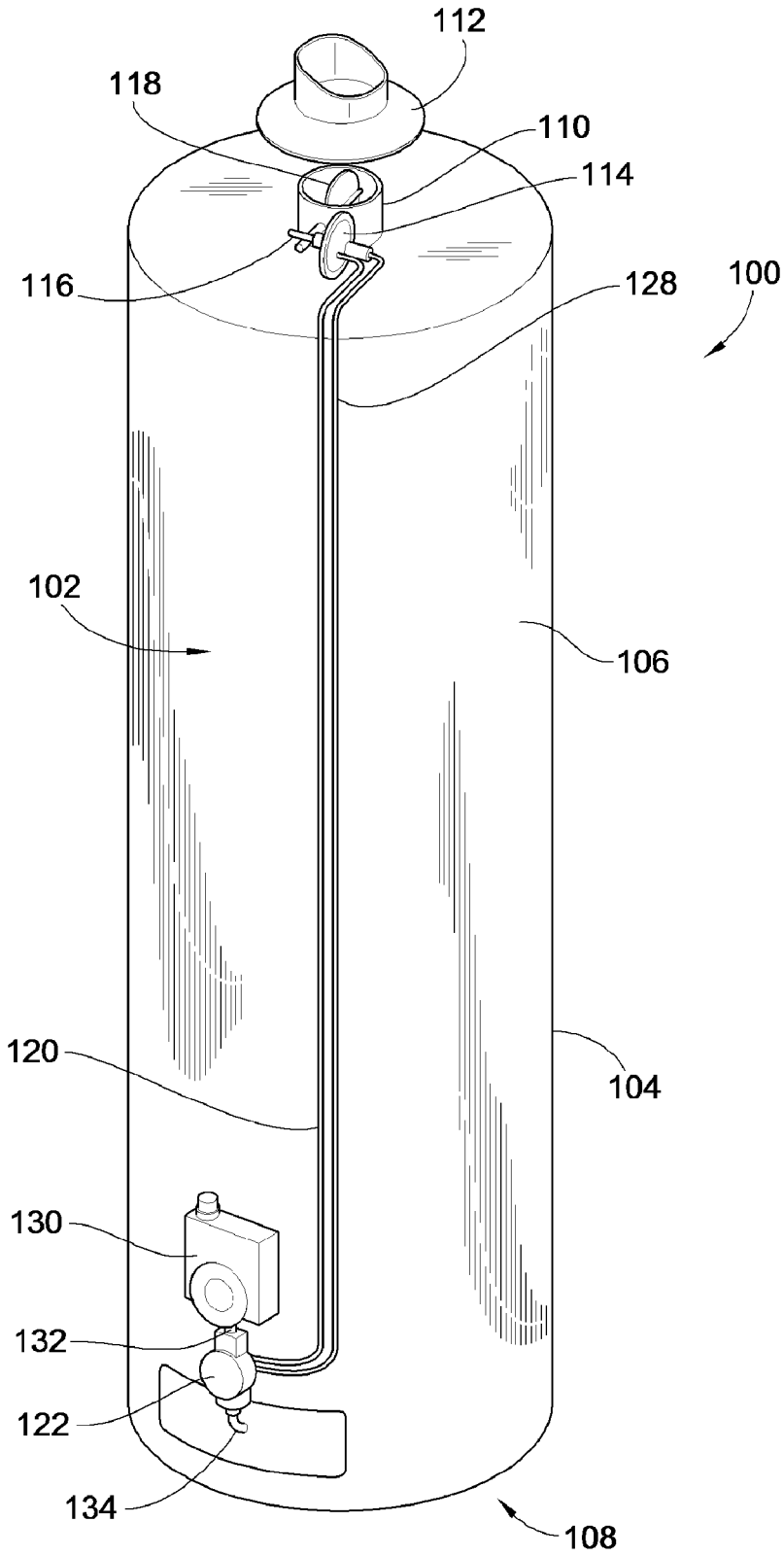
FIG. 1 is an isometric view of an indoor hot water heater having installed thereon an embodiment of the bypass gas operated standby heat loss prevention system of the present invention.

Turning now to the drawings, there is illustrated in FIG. 1 an indoor hot water heater 100 such as typically installed in dwellings in the North American market having installed thereon an embodiment of the standby heat loss control system 102 of the present invention. It should be noted that while the following description will discuss various embodiments of the present invention, such embodiments and operative environments to which these embodiments find particular applicability are provided by way of example and not by way of limitation. For example, the embodiment illustrated in FIG. 1 having the components of the standby heat loss control system 102 exposed, such as in a retrofit installation on an existing hot water heater 100, may instead in a different embodiment have one or more of such components and plumbing integrated into the combination gas controller 130 and/or housing 104 such that they are not visible to the consumer. Embodiments of the present invention may also find applicability in other gas burning appliances, e.g. a furnace, gas log, etc., which typically utilize a flue pipe to exhaust combustion gases during burner operation.

Returning specifically to FIG. 1, the hot water heater 100 includes a cylindrical storage tank 106 for storing the water to be heated by the burner (not shown) located in the bottom 108 of the hot water heater 100. The housing 104 around the storage tank 106 is typically in the form of an insulated round jacket to prevent heat loss through the exterior surface. The heat from the burner is exchanged with the water in the storage tank via the flue pipe 110 that leads from the burner through the storage tank 106 to a draft diverter 112 located on the top of the hot water heater 100. The draft diverter 112 is positioned to collect the hot flue gases from the flue pipe 110, and is coupled to a pipe that is positioned to carry these flue gasses out of the dwelling in which the hot water heater 100 is installed.

In this embodiment, standby heat loss is substantially reduced by the inclusion of a damper actuator valve 114 that is located at the top of the hot water heater 100. A damper flapper valve crank shaft rod 116 driven by the damper actuator valve 114 is connected to a damper flapper valve 118 located on the flue pipe 110. This damper flapper valve 118 is used, as will be described more fully below, to close off the flue pipe 110 when the burner is off. The shape of the damper flapper valve 118 is normally round to close off the typical round flue pipe 110, although it would be square to close off square ducting, etc.

Figure 2:
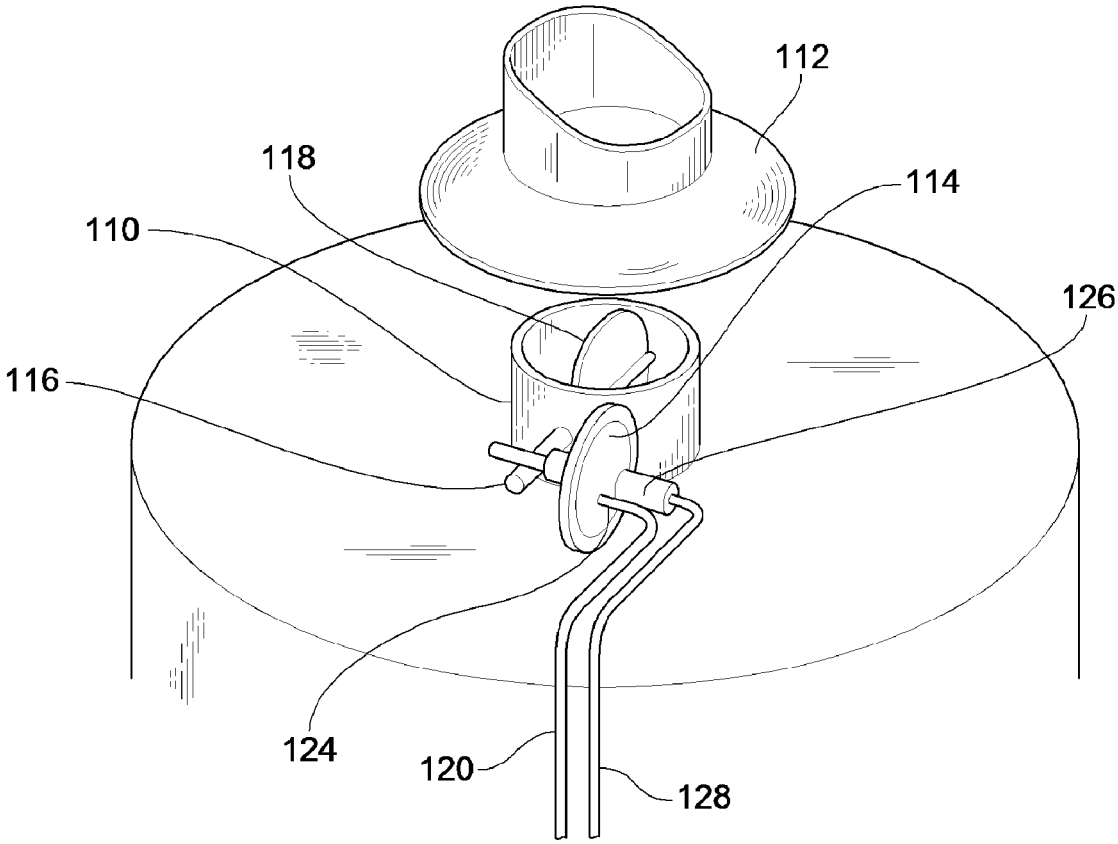
FIG. 2 is an enlarged partial section view of the hot water heater of FIG. 1 illustrating in greater detail the damper and damper actuator valve.

As may be seen from the enlarged partial view of FIG. 2, the inlet 124 of the damper actuator valve 114 is connected via small bore piping 120 to the inlet of the safety relay valve 122 (shown in FIG. 1). The outlet 126 of the damper actuator valve 114 is also connected via small bore piping 128 back to the safety relay valve 122, the details of which will be discussed more fully below with regard to FIGS. 6 and 7.

Returning to the illustration of FIG. 1, it may be seen that the safety relay valve 122 is positioned between the hot water heater's combination gas controller 130 and the burner (not shown). Specifically, the outlet gas feed pipe 132 from the combination gas controller 130 is now connected to the safety relay valve 122, which in turn connected is to the burner feed pipe 134 which leads to the burner.

Although not recognized by prior gas operated damper designs, the safety relay valve 122 should be located immediately after the water heater combination gas controller 130 but as close as possible to the burner so to reduce the effect of pre-ignition and candling. Pre-ignition is defined as attempting to ignite the issued air/gas mixture from the burner ports too early (pressure within the burner head unstable) causing the explosive mixture to flash back through the burner ports and ignite within the burner head. Candling is defined as the draining of the gas in the burner feed pipe after the burner has been commanded off, so as to cause a small flame at the injector resulting in the gradual sooting up of the burner and bad combustion. This is especially a problem with gases heavier than air such as propane, butane gas.

Figure 3:
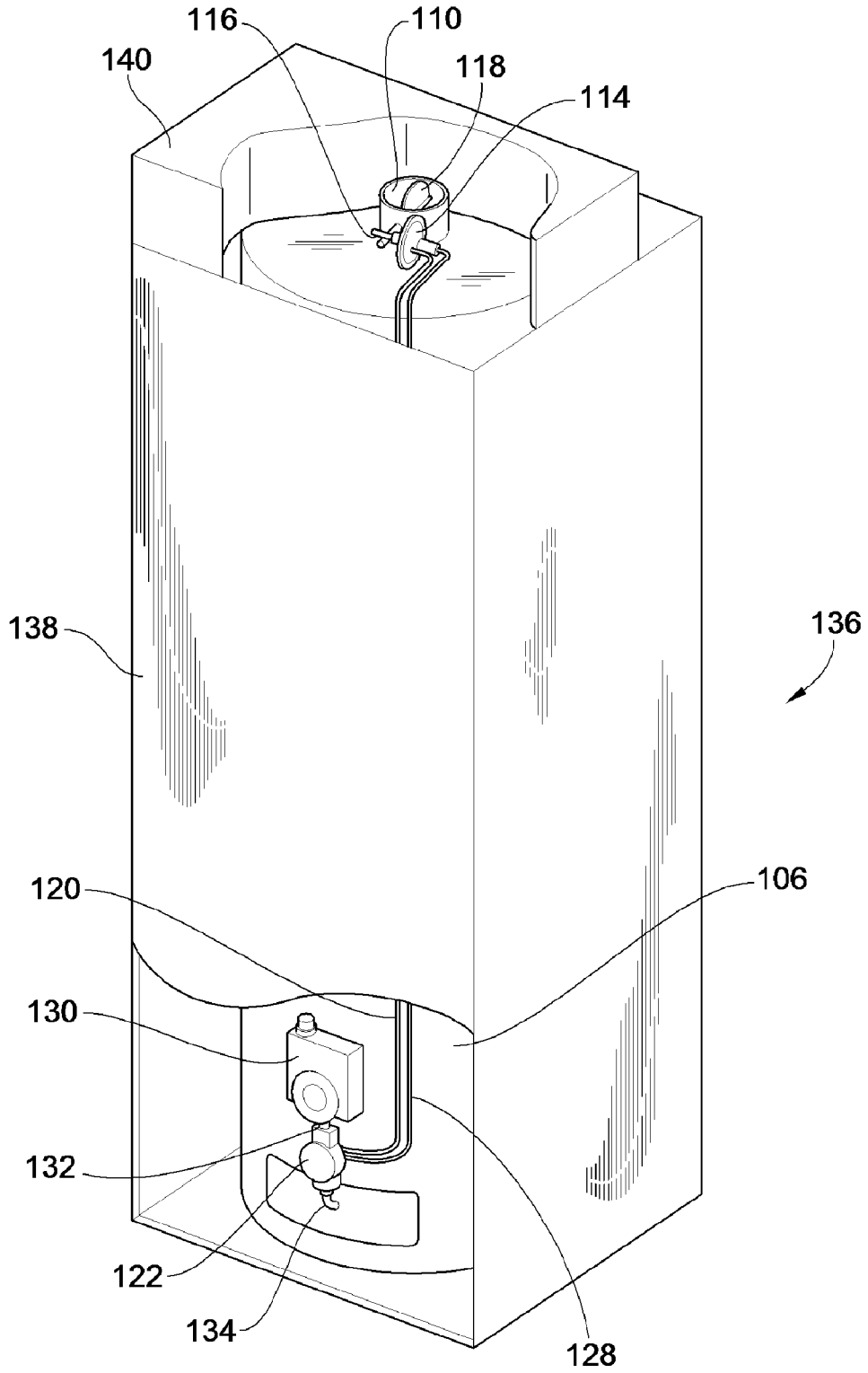
FIG. 3 is an isometric view of an square outdoor water heater having installed thereon on embodiment of the standby heat loss prevention system of the present invention showing the position of the damper actuator valve and safety relay valve.

As discussed above, markets outside of North America, such as in Australia, install their hot water heaters outside of the dwellings. An embodiment of one such outdoor hot water heater 136 is illustrated in FIG. 3. The outdoor hot water heater 136 includes the cylindrical storage tank 106 housed in a rectangular jacket 138. A balanced flue terminal 140 is located on the top to collect the hot flue gases and disperse them from the front of the hot water heater 136.

Figure 10:
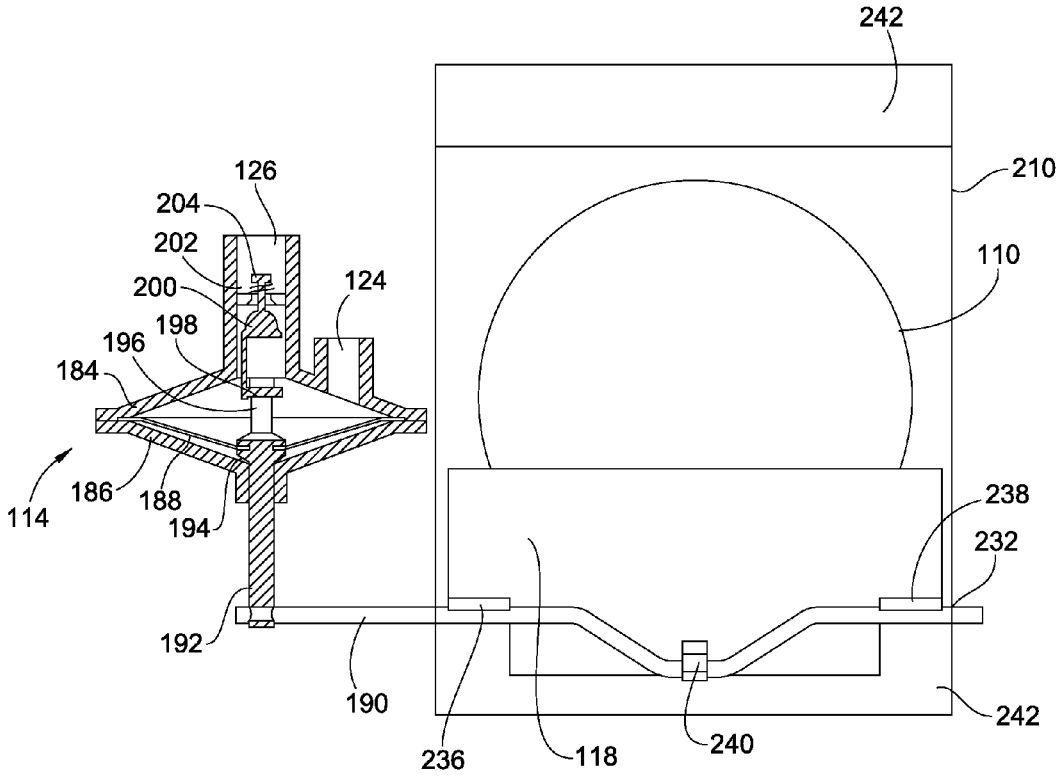
FIG. 10 is a diagrammatic cross section of a damper actuator valve with a plug cock used to control the supply of bleed gas upon rotation of the crank shaft constructed in accordance with an embodiment of the present invention.

The damper actuator valve 114 is located inside the terminal 140, attached to the outside of the transfer duct, which is adjacent to the heater flue pipe as it exits into the transfer duct (show in this illustration as 110 for ease of understanding). In this embodiment the damper actuator valve 114 is located close to the cylinder flue pipe 110 outlet in order to reduce standing losses as discussed above. As shown in FIG. 10 and discussed more fully below, the damper flapper valve 118 may utilize a valve seat bracket 210 configured for fitment into the balanced flue terminal 140 of the outdoor water heater 136 to ensure proper close off and venting therethrough. It should also be located either outside the terminal 140 away from the fresh air inlet or alternately be positioned in the terminal 140 but located so as not to create any turbulence under windy condition, e.g. in a static wind pocket within the terminal 140.

The damper flapper valve 118 to closed off the flue pipe 110 is located immediately over the outlet of the flue pipe 110 inside the transfer duct and is in communication with the damper actuator valve 114 via the damper flapper valve crank shaft rod 116. Small bore piping 120, 128 is used to connect the safety relay valve 122 to the damper actuator valve 114 as in the previous embodiment. The outlet gas feed pipe 132 from the combination gas controller 130 is now connected to the safety relay valve 122, which in turn connected is to the burner feed pipe 134 on supply gas to the burner. The tank 106 is insulated within the square jacket 138, which also provides internal pathways for the air to be transferred from the top terminal 140 to the burner at the bottom of the appliance.

Figure 4:
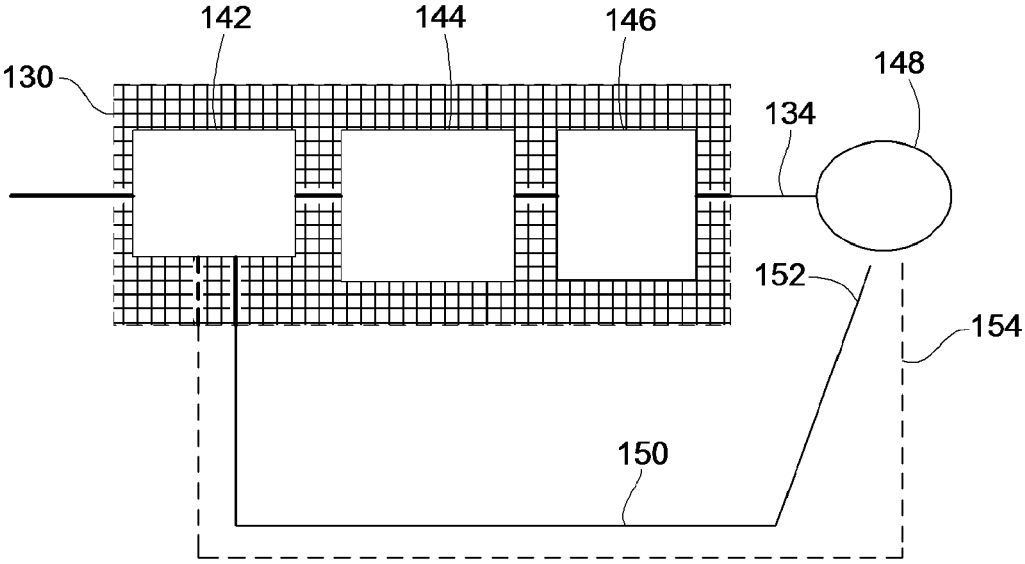
FIG. 4 is a block diagrammatic view of the primary functional activity components of the gas control system of a typical storage hot water heater.

To help understand the control provided by the various components of embodiments of the present invention, an understanding of a typical water heater combination gas controller 130 must first be had. To aid this, attention is now directed to the block diagram of FIG. 4, which illustrates the functional blocks of a standard hot water heater combination gas controller 130. The combination gas controller 130 incorporates in block 142 an off/pilot/on valve, pilot electro magnetic safety valve thermocouple system and a pilot regulator. The combination gas controller 130 also includes a thermostat 144 to control the gas to the burner 148 to heat up the water to a predetermined temperature, and a gas regulator 146 to regulate pressure to the main burner 148. To establish a safe pilot flame for burner ignition, functional block 142 supplies gas via a pilot feed pipe 150 to the pilot 152. A flame sensor 154, such as a thermocouple, is used to sense the presence of flame at the pilot 152 as a feedback to block 142.

Figure 5:
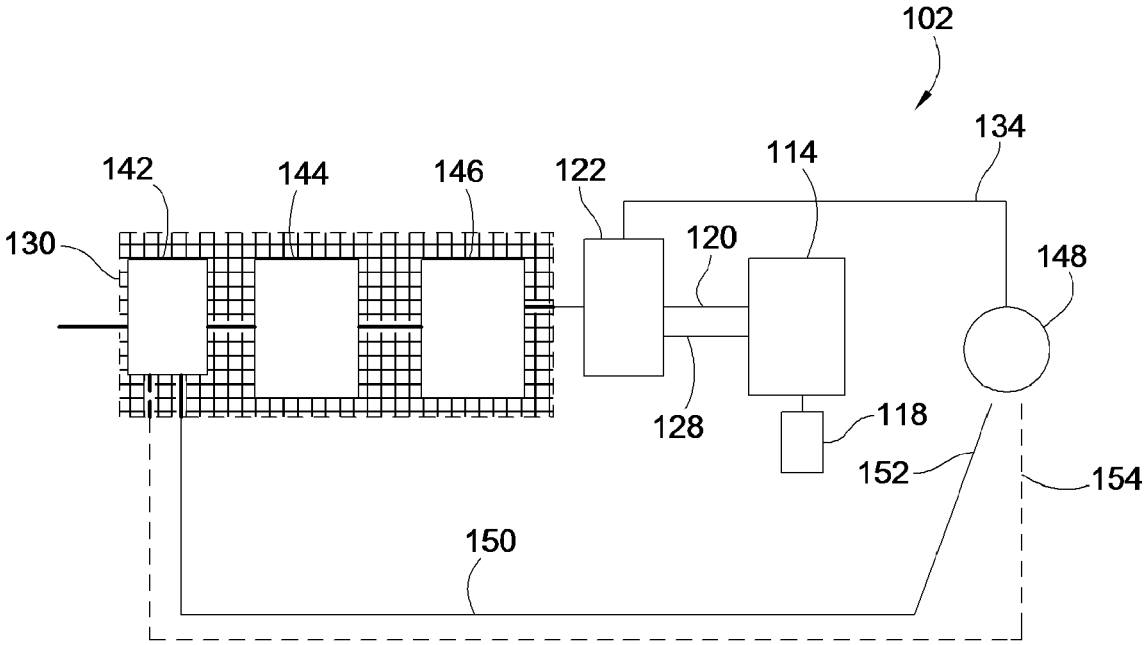
FIG. 5 is a block diagrammatic view of functional activity components of one embodiment of the gas control system of a storage hot water heater showing the additional components of the standby heat loss control system.

With this basic understanding in mind, attention is now directed to FIG. 5, which illustrates a simplified block diagram showing the functional connections between the combination gas controller 130 and components of one embodiment of the standby heat loss prevention system 102 of the present invention. It should be noted, however, that while this description and illustration show the safety relay valve 122 located outside of the housing of the combination gas controller 130, other embodiments of the present invention include the safety relay valve 122 within the same housing as the combination gas controller 130 (which refers to the functional elements and not the packaging thereof). As such, in the following description and claims, when the safety relay valve 122 is described as being installed between the combination gas controller 130 and the burner 148, this is a functional description and not a physical one, i.e. the safety relay valve 122 may be packaged within the same housing of the combination gas controller 130 or outside of the housing of the combination gas controller 130.

In either physical layout, the combination gas controller 130 remains unchanged in operation as discussed above. However, instead of having the gas regulator 146 coupled to the burner feed pipe 134, it is coupled to the safety relay valve 122, which is then coupled to the burner feed pipe 134. As discussed above, small bore pipe 120, 128 is used to couple the safety relay valve 122 to the damper actuator valve 114 to drive the damper flapper valve 118. The advantage of using bleed gas to control the position of the damper flapper valve 118 and the operation of the safety relay valve 122, as opposed to using the main gas flow in prior designs, will be discussed more fully below once the details of an embodiment of the various components are better understood.

Figure 6:
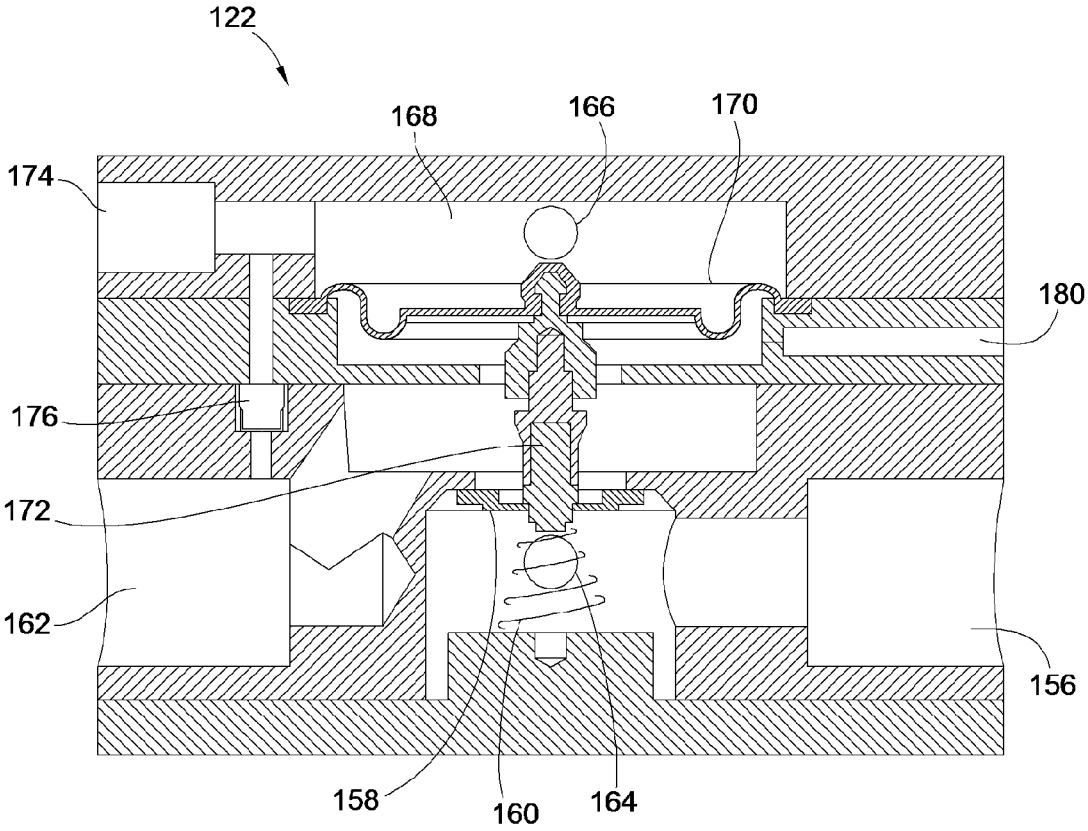
FIG. 6 is a diagrammatic cross section of a safety relay valve constructed in accordance with one embodiment of the present invention.

The details of one embodiment of a safety relay valve 122 are shown in the cross sectional illustration of FIG. 6. As may be seen, the safety relay valve 122 contains an inlet 156 to receive gas from the combination gas controller 130. A main controlling valve 158 with a valve return spring 160 is positioned between the inlet 156 and the outlet 162. The inlet chamber of the safety relay valve 122 includes a first connection port 164 for supplying bleed gas via small bore piping 120 to the damper actuator valve 114. A second connection port 166 for receiving bleed gas back from the damper actuator valve 114 via the small bore piping 128 is located in a diaphragm control chamber 168.

A diaphragm 170 is positioned within the diaphragm control chamber 168, and is operatively coupled to the main valve control shaft 172. Displacement of the diaphragm 170 based on pressure within the diaphragm control chamber 168 will operate to open or allow the main controlling valve 158 to close under pressure of spring 160 as will be discussed more fully below. Diaphragm vent passage 180 will prevent any net pressure build up below the diaphragm 170 during displacement thereof. Once the main controlling valve 158 has been opened, gas is allowed to flow from the inlet 156 through the outlet 162 to the burner via the burner feed pipe 134.

Figure 7:
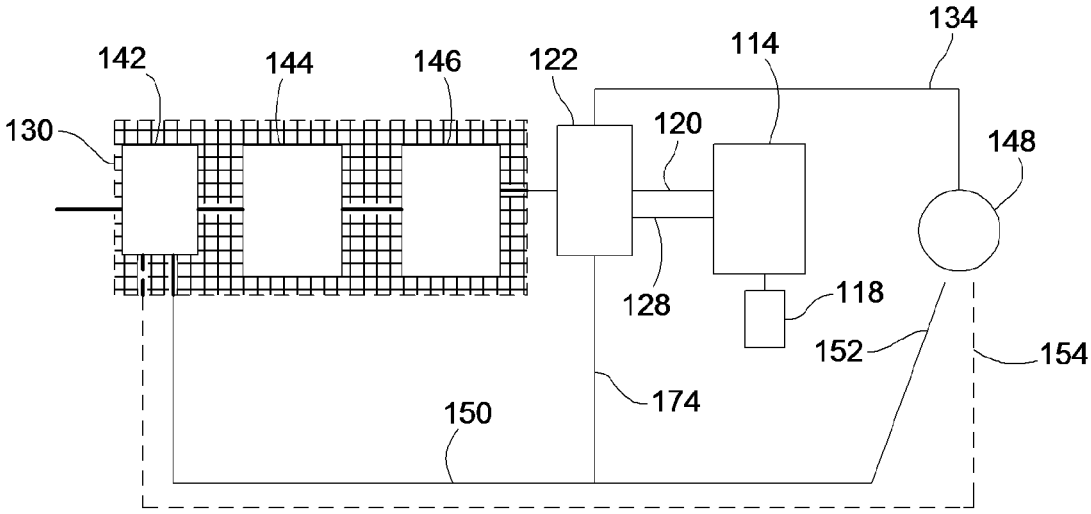
FIG. 7 is a block diagrammatic view of functional activity components of an embodiment of the gas control system of the present invention utilizing a pilot boost connection.
Figure 8:
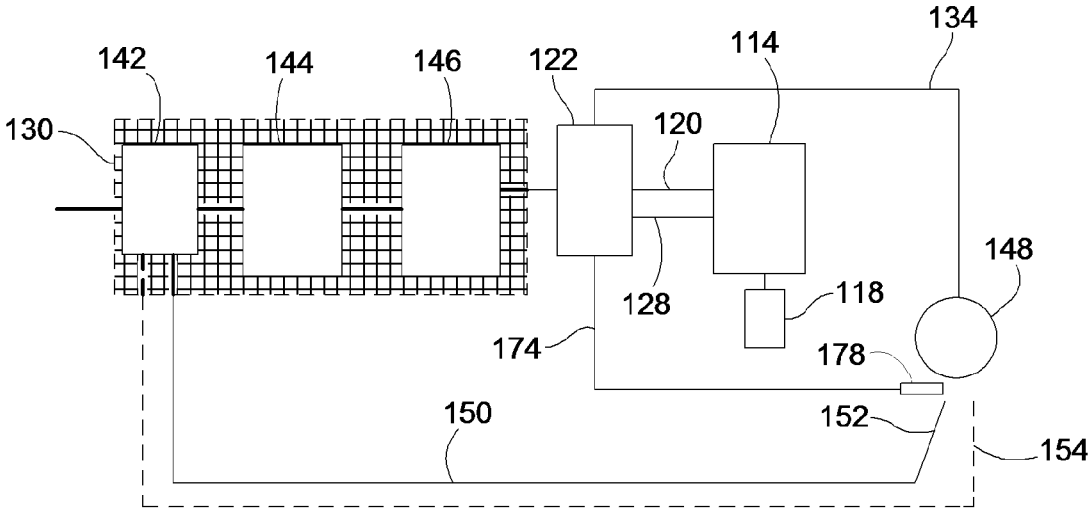
FIG. 8 is a block diagrammatic view of components of an embodiment of the gas control system of the present invention utilizing a booster pilot.

In the illustrated embodiment of FIG. 6, the safety relay valve 122 includes an optional booster pilot gas connection 174 for providing gas to a booster pilot, such as that described in co-pending application Ser. No. 12/175,504, entitled Micro-Pilot for Gas Appliance, filed on even date herewith and assigned to the assignee of the instant application, the teachings and disclosure of which are hereby incorporated in their entireties by reference thereto. As illustrated in FIG. 7, such a booster pilot gas connection 174 may be used to supply additional gas to the pilot feed pipe 150 to increase the pilot 152 flame just prior to opening of the main flow of gas to the burner 148 to aid in ignition thereof. In another embodiment as illustrated in FIG. 8, the booster pilot gas connection 174 could be coupled to a booster pilot 178 in addition to the pilot 152. In such an embodiment, the pilot 152 can be a micro pilot having a very small flame that is at least capable of igniting the gas flowing from the booster pilot gas connection 174 to the booster pilot 178, which is then used to ignite the main flow of gas to the burner 148.

If a booster pilot is not desired or included in the particular installation, the bleed gas from the second connection port 166 can be distributed internally through passage 176 down stream of the valve 158, to outlet 162. This will allow proper timing and operation of the system 102 as will be discussed more fully below.

Figure 9:
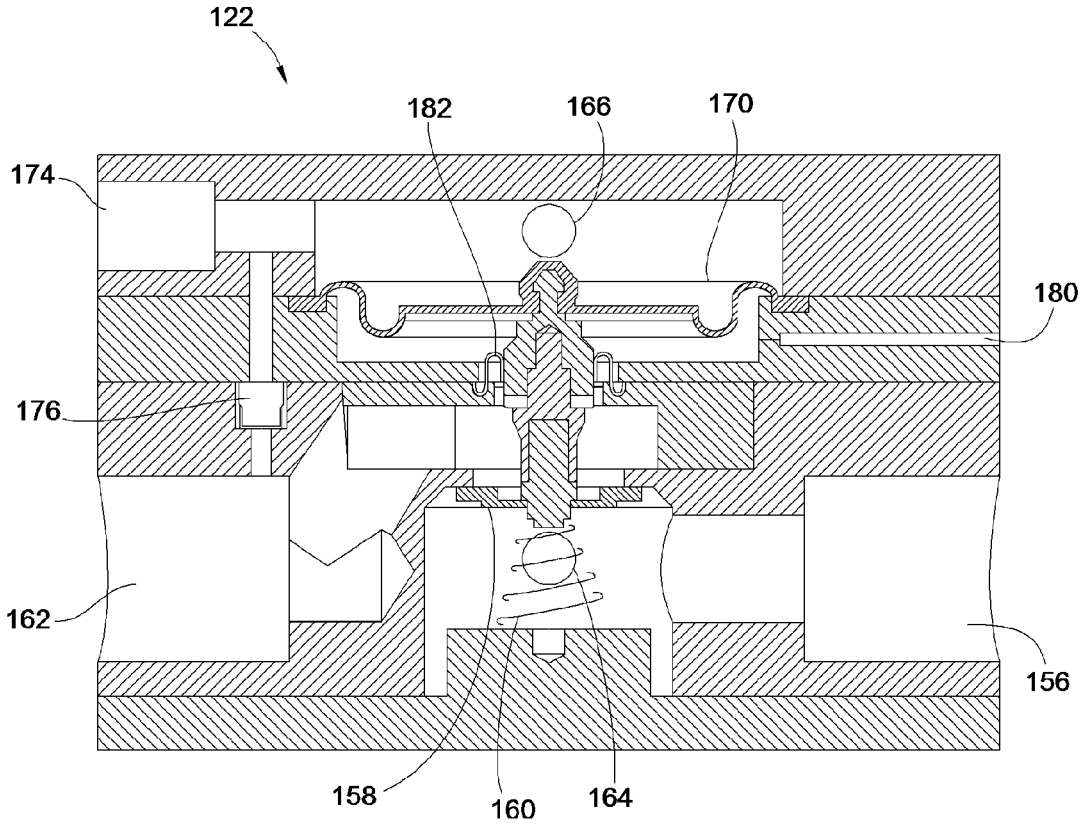
FIG. 9 is a diagrammatic cross section of an atmospheric compensated safety relay valve constructed in accordance with another embodiment of the present invention.

FIG. 9 illustrates another embodiment of the safety relay valve 122. In this embodiment, which is atmospherically compensated, the safety relay valve 122 provides improved gas pressure controlling performance at low inlet pressures. This embodiment is particularly useful when the gas pressure supplied to the hot water heater is low, e.g. as in installations in Australia that utilize natural gas. In addition to the components of the embodiment illustrated in FIG. 6, the safety relay valve 122 illustrated in FIG. 9 includes a diaphragm 170 to operate the main valve 158 which is smaller than a top bleed diaphragm 182. The design and size of orifices within the bleed system (which defines the size of the booster pilot if utilized and how fast the valves open and close) should be such as to ensure the valves close tightly against extremes of high and low gas pressures likely to be encountered. Gas is bled off from the relay valve bleed orifice at a slower rate than supplied to ensure pressurising the damper actuator and relay diaphragms.

Turning now to FIG. 10, there is illustrated a cross-sectional view of an embodiment of a damper actuator valve 114 and damper flapper valve 118 covering the outlet of the water heater flue pipe 110. The damper actuator valve 114 incorporates a gas inlet 124 formed in one half of the metal casing 184, 186, a diaphragm 188, a crank shaft 190 attached to the damper flapper valve 118, a metal push rod 192 in communication with the diaphragm 188 and crank shaft 190, a push rod return spring 194, a diaphragm connection loop 196, a safety valve connection hook 198, a damper actuator safety valve 200, a bypass 202 in the damper actuator safety valve 200, a safety valve return spring 204 and a outlet gas connection 126 to bleed gas back to the safety relay valve 122. The damper actuator safety valve bypass 202 is a small pilot hole, by way of example only approx. 0.50 diameter to ensure all the gas drains from the damper actuator valve 114 when the gas burner is turned off to allow the damper flapper valve 118 to tightly close.

As indicated above, upon the thermostat calling for heat gas is supplied to inlet of the closed safety relay valve 122. Gas is then supplied to the damper actuator valve inlet 124 pressuring the diaphragm 188. The displacement of the diaphragm 188 forces the push rod 192 to move which in turn rotates the crankshaft rod 190 to open the damper flapper valve 118 sufficiently for good combustion. The continued pressurising and resulting further displacement of the diaphragm 188 finally drags a damper actuator safety valve 200 off its seat, which allows gas to be bled back to the safety relay valve 122 through outlet 126. This function of the gas safety valve being finally dragged off its seat when the flapper valve is opened sufficiently for good combustion may be defined as a damper actuator safety valve drag distance. This distance must be accurately controlled for safety and may be accomplished in many ways.

As shown in this FIG. 10, the diaphragm connection loop 196 and safety valve connection hook 198 are sized relative to one another to ensure proper damper actuator safety valve drag distance. Other embodiments may use a chain between the diaphragm 188 and the damper actuator safety valve 200 of a length to ensure that the chain is only taunt, and therefore finally drags the damper actuator safety valve 200 off its seat once the damper actuator safety valve drag distance has been spanned. Other mechanisms may include a rod with stop, located inside a tube with a slot, or that shown in FIGS. 2 and 3 of U.S. Pat. No. 4,076,171.

Also shown in FIG. 10, a valve seat bracket 210 configured to fit into the square transfer duct of the terminal 140 (see FIG. 3) of the outdoor water heater. The damper flapper valve 118 (shown in an open position) utilizes the edge 232 of the valve seat bracket 210 as a floating fulcrum point. In this way, the damper flapper valve 118 is simply allowed to lay on top of the valve seat bracket 210 in a closed position. Because the valve seat bracket 210 is sized to fit inside the terminal 140 there is little to no heat loss through the transfer duct of the terminal 140 (FIG. 3) while the damper flapper valve 118 is lying on top of the valve seat bracket 210. Only when the damper flapper valve 118 is in an open position, such as shown in FIG. 10, can the hot flue gases flow from the top of the flue pipe 110 through the opening in the valve seat bracket 210 and out through the transfer duct.

As may be seen in this FIG. 10, fold up tabs 236, 238 are formed on either side of the v-shaped bend in the crank shaft 190. A capture tab 240 is also formed to engage the crank shaft 190 in the center of the v-shape bend therein. In such a configuration, the angle of opening of the damper flapper valve 118 is roughly limited by the angle of the positioning legs 242 of the valve seat bracket 210.

Figure 11:
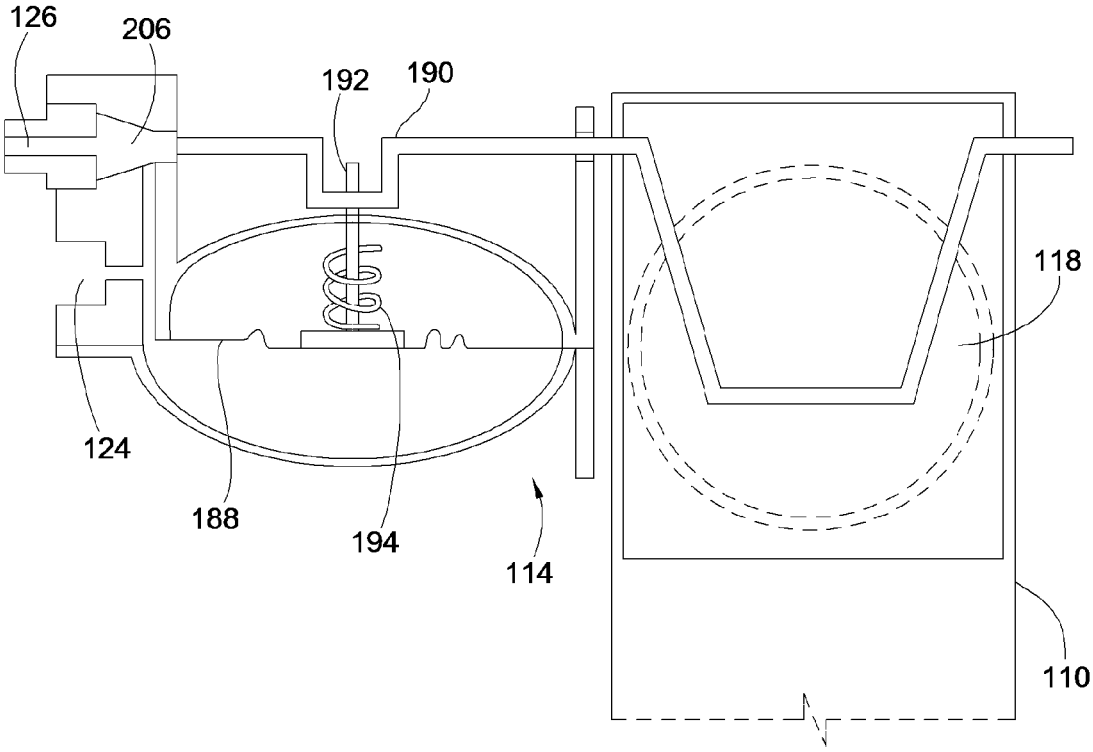
FIG. 11 is a diagrammatic cross section of a damper actuator valve with an on/off gas valve operated by the location of the diaphragm and flapper valve constructed in accordance with another embodiment of the present invention.
Figure 12:
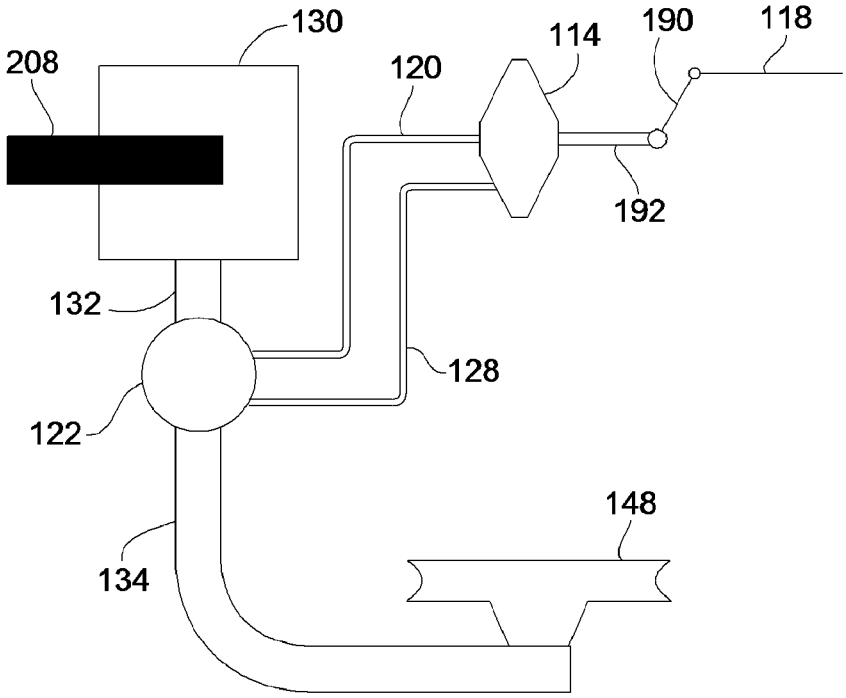
FIGS. 12-16 are schematic gas flow diagrams illustrating sequential gas flow and damper control provided by one embodiment of the standby heat loss control system of the present invention.

FIG. 11 illustrates an alternate embodiment of the damper actuator valve 114. In this embodiment the damper actuator valve 114 incorporates an inlet bleed gas connection 124 to receive gas from the safety relay valve 122, a diaphragm 188, a push rod 192 connected to the diaphragm 188 and crank shaft 190. At one end of the crank shaft 190 is connected the damper flapper valve 118 which closes of the flue pipe 110. On the other end of the crank shaft 190 is an on/off gas valve 206 which opens and closes off the bleed gas to the safety relay valve 122 via outlet 126 depending on the gas pressure and location of the diaphragm 188 and damper flapper valve 118. The damper actuator valve 114 is configured so the damper flapper valve 118 is open sufficiently for good combustion prior to the on/off gas valve 206 allowing gas to pass through it on the way to the safety relay valve 122.

With a thorough understanding of various embodiments of the components of the standby energy loss prevention system 102 of the present invention, attention will now be turned to FIGS. 12-16, which illustrate the gas flow through the system at each stage of operation. The presence of gas is illustrated in these figures as a darkened area in the piping and/or components. For example, in FIG. 12, gas is present in gas supply pipe 208 at the inlet to the combination gas controller 130, such as e.g. a Robertshaw R110, R220 or SIT AC3 controller. However, since in this figure the combination gas controller 130 has not initiated a call for heat, there is no gas in the outlet gas feed pipe 132 leading to the safety relay valve 122.

Figure 13:
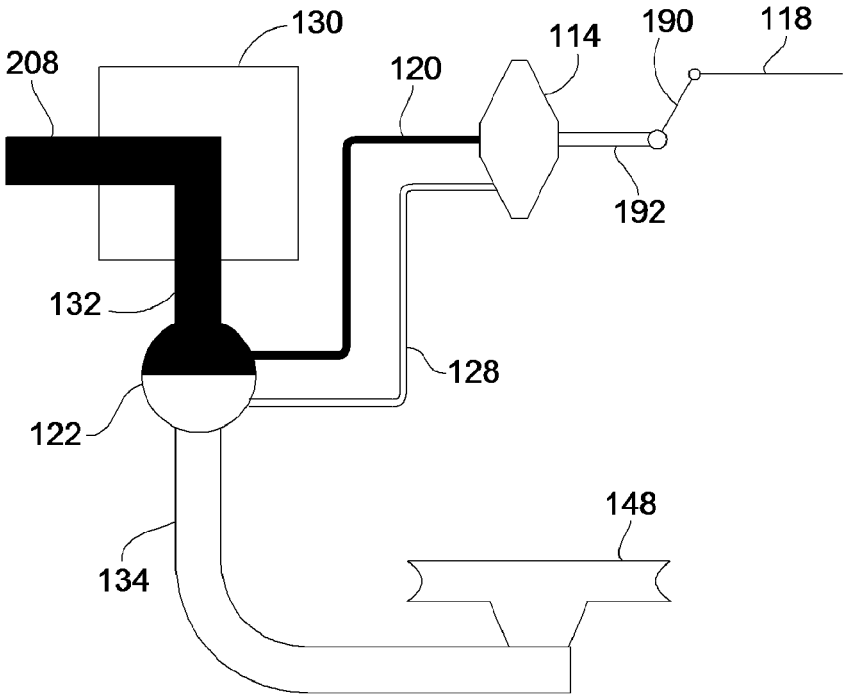

As illustrated in FIG. 13, when the thermostat in combination gas controller 130 calls for heat, the internal gas valve opens allowing gas to flow through the combination gas controller 130 and the outlet gas feed pipe 132 to the inlet of the closed safety relay valve 122. A bypass flow of gas is piped from the inlet of the safety relay valve 122 though the micro bore piping 120 to the damper actuator valve 114. The size of the micro bore piping 120 may vary somewhat, and is preferable in the range of about 3 mm to 5 mm aluminium tube for typical hot water heater installations.

Figure 14:
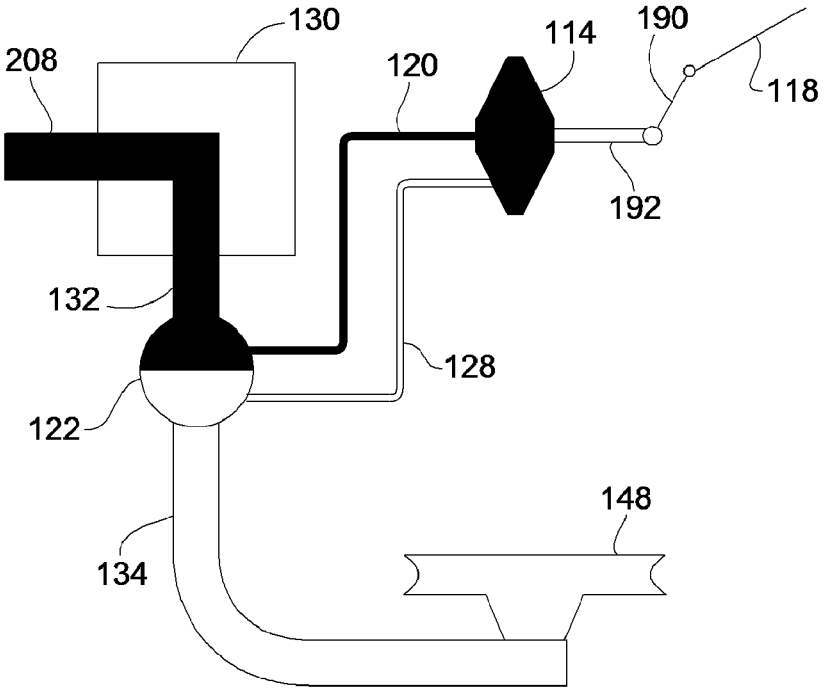

The damper actuator valve 114 is pressurised as shown in FIG. 14, forcing the push rod 192 to move outwards. The push rod 192 movement forces the crank shaft 190 to rotate, thereby opening the damper flapper valve 118. Continued movement of the baffle in the damper actuator valve 114 will eventually drag the damper actuator safety valve off its seat. As discussed above, the design is such that gas will not issue through the damper actuator safety valve until the damper flapper valve 118 is sufficiently open for good combustion.

Figure 15:
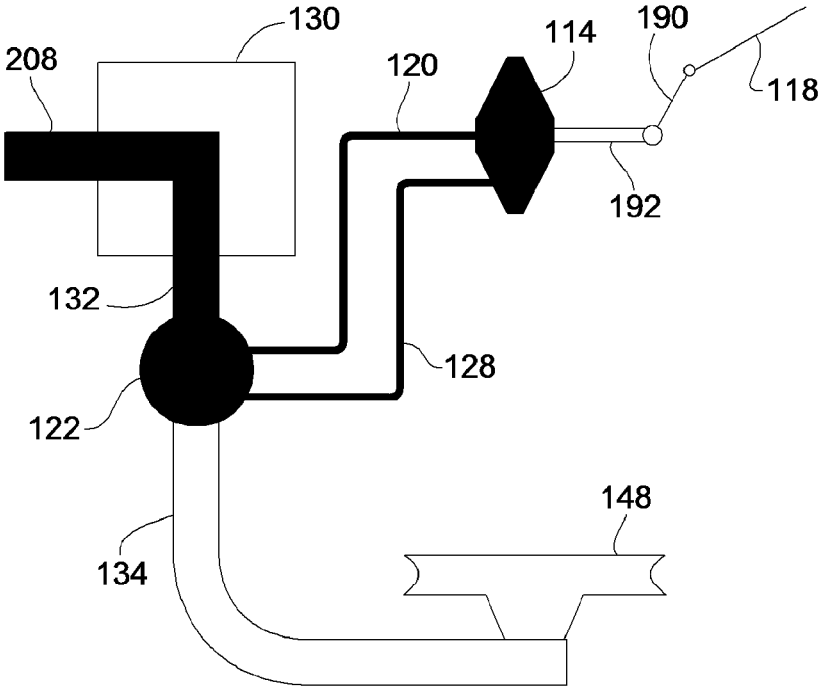

As illustrated in FIG. 15, the opened damper actuator safety valve allows the gas to bleed from the damper actuator valve 114, through micro bore piping 128 back down to the top side of the diaphragm in the safety relay valve 122. In embodiments that include a booster pilot, the flow from the damper actuator valve 114 at a faster rate than issues from the booster pilot outlet, thus pressurising the safety relay valve 122 diaphragm. The bleed gas starts to pressurise the relay diaphragm and is also bled to the booster pilot which ignites from the micro-pilot in such embodiments that includes a booster pilot (see FIG. 8), or increases the gas flow to the pilot in embodiments that include this feature (see FIG. 7).

Figure 16:
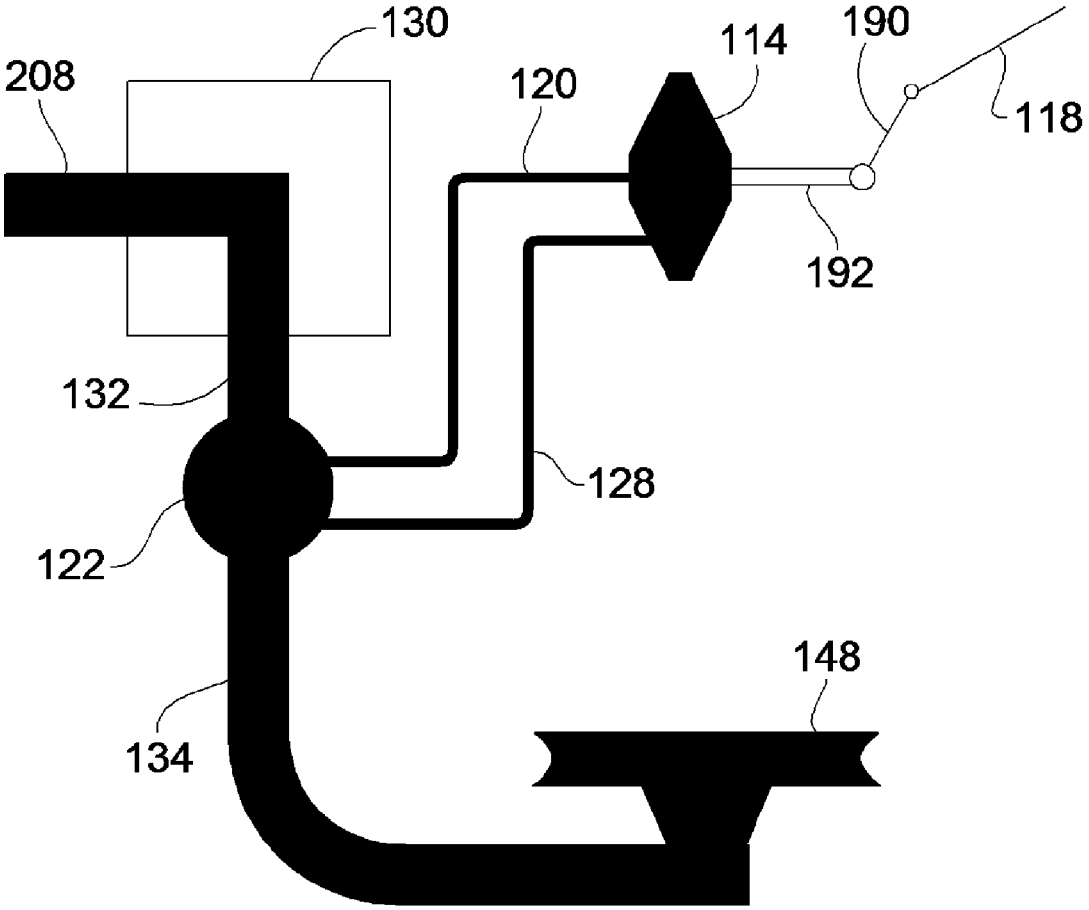

As illustrated in FIG. 16, once the safety relay valve 122 is finally pressurized, its main gas valve is forced open against the gas pressure and return spring force. Gas then issues to the main burner 148 via the burner feed pipe 134, where it is ignited by the pilot or booster pilot. In embodiments such as shown in FIGS. 7 and 8, gas continues to bleed from the top side of the diaphragm of the safety relay valve 122 continues to be burnt in the combustion chamber when the main burner 148 is on. In embodiments that do not include the booster pilot outlet, gas bleeds from the top side of the diaphragm of the safety relay valve 122 to the gas feed pipe 134 to be added to the main gas flow therethrough.

Once the combination gas controller 130 determines that the water temperature has reached its set point temperature, it turns off all gas to the safety relay valve 122. Gas drains out of the damper of the damper actuator valve 114 where upon the return spring, returns the push rod 192 to the original position rotating the crankshaft 190 which closes the damper flapper valve 118 and damper actuator safety valve inside the damper actuator valve 114. Gas continues to drain from the damper actuator safety valve bypass and from the diaphragm chamber of the safety relay valve 122, which allows the return spring to close off the main gas valve thus stopping all gas to the burner. The burner main flame is extinguished as well as the booster pilot leaving only the pilot or micro-pilot on.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A system to reduce standby energy loss in a gas burning appliance having a burner and a flue pipe for exhausting combustion gases from the burner, the gas burning appliance further having a combination gas controller for controlling a flow of gas to enable combustion and to disable combustion, comprising:

a safety relay valve interposed between the combination gas controller and the burner, the safety relay valve having a housing forming an inlet for receiving gas when the combination gas controller enables combustion, an outlet for providing gas to the burner, a first connection port in fluid communication with the inlet, a diaphragm control chamber, and a second connection port in fluid communication with the diaphragm control chamber, the safety relay valve further including a main controlling valve positioned between the inlet and the outlet to control a flow of gas from the inlet to the outlet, the main controlling valve including a valve control shaft drivably coupled to a diaphragm positioned in the diaphragm control chamber;

a damper actuator valve having an inlet in fluid communication with the first connection port and an outlet in fluid communication with the second connection port, the damper actuator valve further including a diaphragm operably coupled to a push rod having a first end operably coupled to a damper actuator safety valve positioned between the inlet and the outlet such that the push rod must traverse a damper actuator safety valve drag distance before the first end causes the damper actuator safety valve to open, and a second end; and a damper flapper valve operatively coupled to the second end of the push rod and installed in proximity to a top end of the flue pipe such that closure of the damper flapper valve reduces thermal communication from the flue pipe to an environment.

2. The system of claim 1, wherein the safety relay valve is positioned in close proximity to the burner.

3. The system of claim 1, wherein the first connection port is coupled to the inlet of the damper actuator valve and the second connection port is coupled to the outlet of the damper actuator valve by micro bore piping.

4. The system of claim 1, wherein the housing of the safety relay valve further defines a passage from the diaphragm control chamber to the outlet.

5. The system of claim 4, wherein the passage has a first diameter less than a second diameter of the second connection port.

6. The system of claim 1, wherein the housing of the safety relay valve further defines a booster pilot gas connection outlet in fluid communication with the diaphragm control chamber.

7. The system of claim 6, wherein the gas burning appliance includes a pilot supplied with gas by a pilot feed pipe, and wherein the booster pilot gas connection is operatively coupled to the pilot feed pipe to supply additional gas thereto to increase a size of a pilot flame produced by the pilot to aid ignition of the burner.

8. The system of claim 6, wherein the gas burning appliance includes a micro pilot supplied with gas by a pilot feed pipe, further comprising a booster pilot positioned in proximity to the micro pilot and the burner and in fluid communication with the booster pilot gas connection.

9. The system of claim 1, wherein the damper actuator safety valve is coupled to the first end of the push rod by a safety valve connection hook.

10. The system of claim 1, wherein the damper actuator safety valve is coupled to the first end of the push rod by a chain.

11. The system of claim 1, wherein the housing of the safety relay valve further defines a diaphragm vent passage positioned on an opposite side of the diaphragm from the second connection port.

12. The system of claim 11, further comprising a bleed diaphragm coupled to the valve control shaft at a location displaced from the diaphragm such that the diaphragm vent passage is positioned therebetween.

13. The system of claim 1, wherein upon receipt of gas at the inlet of the safety relay valve a small amount of bypass gas flows from the first connection port to the inlet of the damper actuator valve, and wherein the bypass gas results in displacement of the diaphragm in the damper actuator valve which linearly translates the push rod and opens the damper flapper valve, and wherein after the diaphragm of the damper actuator valve has linearly translated the push rod by the damper actuator safety valve drag distance the push rod opens the damper actuator safety valve to allow the bypass gas to flow from the outlet of the damper actuator valve to the second connection port of the safety relay valve, and wherein the bypass gas causes a displacement in the diaphragm of the safety relay valve which linearly translates the valve control shaft to open the main controlling valve to allow gas to flow from the inlet of the safety relay valve to the outlet of the safety relay valve.

14. A gas hot water heater having low standby energy loss, comprising:

a storage tank having a burner positioned at a bottom thereof and a flue pipe for exhausting combustion gases passing through the storage tank and in thermal communication with water stored therein;

a controller for sensing a temperature of water in the storage tank and for controlling a flow of gas from an external source to enable combustion when the temperature is below a threshold and to disable combustion when the threshold is met;

a safety relay valve interposed between the combination gas controller and the burner, the safety relay valve having a housing forming an inlet for receiving gas when the combination gas controller enables combustion, an outlet for providing gas to the burner, a first connection port in fluid communication with the inlet, a diaphragm control chamber, and a second connection port in fluid communication with the diaphragm control chamber, the safety relay valve further including a main controlling valve positioned between the inlet and the outlet to control a flow of gas from the inlet to the outlet, the main controlling valve including a valve control shaft drivably coupled to a diaphragm positioned in the diaphragm control chamber;

a damper actuator valve having an inlet in fluid communication with the first connection port and an outlet in fluid communication with the second connection port, the damper actuator valve further including a diaphragm operably coupled to a push rod having a first end operably coupled to a damper actuator safety valve positioned between the inlet and the outlet such that the push rod must traverse a damper actuator safety valve drag distance before the first end causes the damper actuator safety valve to open, and a second end; and a damper flapper valve operatively coupled to the second end of the push rod and installed on the hot water heater in proximity to a top end of the flue pipe such that closure of the damper flapper valve reduces thermal communication from the flue pipe to an environment.

15. The gas hot water heater of claim 14, further comprising a draft diverter positioned above the flue pipe and damper flapper valve.

16. The gas hot water heater of claim 14, further comprising:

a rectangular jacket surrounding the storage tank; and a balanced flue terminal located on top of the rectangular jacket to collect and disperse combustion gases.

17. The gas hot water heater of claim 14, wherein upon receipt of gas at the inlet of the safety relay valve a small amount of bypass gas flows from the first connection port to the inlet of the damper actuator valve, and wherein the bypass gas results in displacement of the diaphragm in the damper actuator valve which linearly translates the push rod and opens the damper flapper valve, and wherein after the diaphragm of the damper actuator valve has linearly translated the push rod by the damper actuator safety valve drag distance the push rod opens the damper actuator safety valve to allow the bypass gas to flow from the outlet of the damper actuator valve to the second connection port of the safety relay valve, and wherein the bypass gas causes a displacement in the diaphragm of the safety relay valve which linearly translates the valve control shaft to open the main controlling valve to allow gas to flow from the inlet of the safety relay valve to the outlet of the safety relay valve.

18. The gas hot water heater of claim 14, wherein the housing of the safety relay valve further defines a passage from the diaphragm control chamber to the outlet.

19. The gas hot water heater of claim 14, wherein the hot water heater includes a pilot supplied with gas by a pilot feed pipe, and wherein the housing of the safety relay valve further defines a booster pilot gas connection outlet in fluid communication with the diaphragm control chamber, the booster pilot gas connection being operatively coupled to the pilot feed pipe to supply additional gas thereto to increase a size of a pilot flame produced by the pilot to aid ignition of the burner.

20. The gas hot water heater of claim 14, wherein the hot water heater includes a micro pilot supplied with gas by a pilot feed pipe, and wherein the housing of the safety relay valve further defines a booster pilot gas connection outlet in fluid communication with the diaphragm control chamber, further comprising a booster pilot positioned in proximity to the micro pilot and the burner and in fluid communication with the booster pilot gas connection.

21. The gas hot water heater of claim 14, wherein the combination gas controller and the safety relay valve are contained in a common housing.

* * * * *